US006695426B2

(12) United States Patent
Herwald et al.

(10) Patent No.: US 6,695,426 B2
(45) Date of Patent: Feb. 24, 2004

(54) INK JET PRINTER IMPROVED DOT PLACEMENT TECHNIQUE

(75) Inventors: Marc Alan Herwald, Lexington, KY (US); Michael Anthony Marra, III, Lexington, KY (US); Randall David Mayo, Georgetown, KY (US); Brian Andrew Naro, Lexington, KY (US); Barry Baxter Stout, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/074,454

(22) Filed: Feb. 11, 2002

(65) Prior Publication Data

US 2003/0164867 A1 Sep. 4, 2003

(51) Int. Cl.[7] ..... B41J 29/393
(52) U.S. Cl. ..... 347/19
(58) Field of Search ..... 347/19, 37; 400/283

(56) References Cited

U.S. PATENT DOCUMENTS

| | | | | |
|---|---|---|---|---|
| 4,203,678 A | | 5/1980 | Nordstrom et al. | 400/320 |
| 4,439,775 A | | 3/1984 | Johnson | 346/75 |
| 4,460,968 A | | 7/1984 | Cavill et al. | 364/519 |
| 4,526,486 A | | 7/1985 | Kikuchi et al. | 400/185 |
| 4,550,320 A | | 10/1985 | Biser et al. | 346/75 |
| 5,075,689 A | | 12/1991 | Hoisington et al. | 346/1.1 |
| 5,300,950 A | | 4/1994 | Lopez et al. | 346/1.1 |
| 5,315,322 A | | 5/1994 | Bannai | 346/108 |
| 5,359,355 A | | 10/1994 | Nagoshi et al. | 347/9 |
| 5,389,959 A | | 2/1995 | Haas | 347/187 |
| 5,448,269 A | | 9/1995 | Beauchamp et al. | 347/19 |
| 5,500,661 A | | 3/1996 | Matsubara et al. | 347/41 |
| 5,527,121 A | * | 6/1996 | Santon | 347/37 |
| 5,633,663 A | | 5/1997 | Matsubara et al. | 347/41 |
| 5,719,602 A | | 2/1998 | Hackleman et al. | 347/14 |
| 5,729,277 A | | 3/1998 | Morrison | 347/248 |
| 5,777,640 A | | 7/1998 | Shioya et al. | 347/15 |
| 5,871,291 A | | 2/1999 | Kawazoe | 400/279 |
| 5,988,784 A | | 11/1999 | Takemura et al. | 347/8 |
| 5,992,968 A | | 11/1999 | Uetsuki et al. | 347/37 |
| 5,997,124 A | | 12/1999 | Capps et al. | 347/14 |
| 6,012,792 A | | 1/2000 | Sievert et al. | 347/3 |
| 6,076,911 A | | 6/2000 | Watanabe | 347/16 |
| 6,076,916 A | | 6/2000 | Kaneko | 347/37 |
| 6,217,150 B1 | | 4/2001 | Heydinger | 347/43 |
| 6,260,945 B1 | | 7/2001 | Niikura | 347/37 |
| 6,273,549 B1 | | 8/2001 | Wetchler et al. | 347/43 |
| 6,302,517 B1 | | 10/2001 | Kanaya | 347/41 |
| 6,318,827 B1 | | 11/2001 | Brenner et al. | 347/9 |
| 6,322,184 B1 | | 11/2001 | Brenner et al. | 347/14 |
| 6,354,216 B1 | * | 3/2002 | Yoshida | 347/37 |

* cited by examiner

*Primary Examiner*—Stephen D. Meier
*Assistant Examiner*—Julian D. Huffman
(74) *Attorney, Agent, or Firm*—Taylor & Aust, P.C.

(57) ABSTRACT

A method is provided to reduce vertical banding defects in an ink jet printer. The method includes the steps of identifying a disturbance frequency of a disturbance source; identifying a natural frequency of a printhead carrier system; correlating the disturbance frequency of the disturbance source and the natural frequency of the printhead carrier system to a base carrier velocity; selecting a first carrier velocity for printing in a first direction, the first carrier velocity being different from the base carrier velocity; and selecting a second carrier velocity for printing in a second direction, the second carrier velocity being different from the base carrier velocity and different from the first carrier velocity.

22 Claims, 8 Drawing Sheets

| PASS | PASS DIRECTION | VELOCITY |
|---|---|---|
| 1 | → | V1 |
| 2 | ← | V2 |
| 3 | → | V1 |
| 4 | ← | V2 |
| ⋮ N | ⋮ | ⋮ |

| PASS | PASS DIRECTION | VELOCITY |
|---|---|---|
| 1 | → | V1 |
| 2 | ← | V2 |
| 3 | → | V2 |
| 4 | ← | V1 |
| 5 | → | V1 |
| ⋮ N | ⋮ | ⋮ |

| CARRIER VELOCITY | PHASE SEPARATION |
|---|---|
| 6.4 ips | 0° |
| 12.9 ips | 180° |
| 19.3 ips | 90° |
| 25.8 ips | 45° |

INK JET PRINTER IMPROVED DOT PLACEMENT TECHNIQUE

BACKGROUND OF THE INVENTION

1. Field of the Invention

The present invention relates to an imaging apparatus, and, more particularly, to an ink jet printer utilizing an improved dot placement technique.

2. Description of the Related Art

A typical ink jet printer forms an image on a print medium by ejecting ink from at least one ink jet printhead to form a pattern of ink dots on the print medium. Such an ink jet printer includes a reciprocating printhead carrier that transports one or more ink jet printheads across the print medium along a bi-directional scanning path defining a print zone of the printer. The bi-directional scanning path is oriented parallel to a main scan direction, also commonly referred to as the horizontal direction. The main scan direction is bi-directional. During each scan of the printhead carrier, the print medium is held stationary. An indexing mechanism is used to incrementally advance the print medium in a sheet feed direction, also commonly referred to as a sub-scan direction or vertical direction, through the print zone between scans in the main scan direction, or after all data intended to be printed with the print medium at a particular stationary position has been completed.

For a given stationary position of the print medium, printing may take place during one or more unidirectional scans of the printhead carrier. As used herein, the term "unidirectional" will be used to refer to scanning in either, but only one, of the two bi-directional scanning directions. Thus, bi-directional scanning refers to two successive unidirectional scans in opposite directions. The term "printing swath" will refer to the depositing of ink on the print medium during a particular unidirectional scan of the printhead carrier at which time individual printhead nozzles of the printhead are selectively actuated to expel ink. A printing swath is made of a plurality of printing lines traced along imaginary rasters, the imaginary rasters being spaced apart in the sheet feed direction.

Typically, each ink jet printhead will include a plurality of ink jet nozzles for expelling the ink. In ink jet printing, it is common to use the ink colors of cyan, magenta, yellow and black in generating color prints. Also, it is common in ink jet printing to have a single printhead having a dedicated nozzle array for each of cyan, magenta and yellow inks, respectively, wherein the three nozzle arrays are aligned vertically, that is, aligned in a direction parallel to the sub-scan direction.

Those working in the imaging arts continually strive to improve the print quality of imaging devices, such as ink jet printers.

One such attempt is directed to reducing the occurrence of horizontal banding defects in printouts generated by an ink jet printer. Horizontal banding defects may be observed on media, such as paper, as a horizontal white band. Such defects are generally attributable to errors generated by the media sheet indexing mechanism that is used to advance a media sheet in a media feed direction through the printer during the printing of the text or image on the media sheet. Such errors can be caused, for example, by mechanical tolerances of the index roller and its associated drive train. It is known to mask such indexing errors by adopting an interlaced printing method, also referred to as shingling, wherein each scan of the printhead carrier (also sometimes referred to in the art as a printhead carriage) is made to vertically overlap a preceding scan. For a given swath, only a portion of the total print data for a given area on the print medium is printed. Thus, each scan of an actuated printhead produces a swath of printed output forming all or portions of multiple print lines, and multiple swaths may be required to complete the printing of any given print line.

Other attempts have been made to improve the print quality of high density printed images by reducing the occurrences of ink pen starvation, ink droplet trajectory errors and fuzzy text edges. For example, in one such attempt, an inkjet printer includes a controller and algorithm for switching automatically intra page between one of two independent high speed carriage velocities and between one of two independent pen firing frequencies based on ink drop densities, wherein when the drop density increases to a maximum level, the printer reduces its carriage velocity and nozzle firing rate to allow sufficient time for the ink deposited onto the media to dry.

Another type of printing defect has been recognized, referred to herein as vertical banding. Vertical banding defects in multi-color printing are typically observed as a repeating pattern of vertical light bands and vertical dark bands in a printed image, and may also appear in multi-color form similar to that of a rainbow. Vertical banding defects are particularly noticeable in high density ink jet printer printouts, such as when attempting to produce photographic quality printouts, but also can be observed in lower density printouts as well.

What is needed in the art is a method to reduce vertical banding in an imaging apparatus, such as an ink jet printer, and hence improve the print quality thereof.

SUMMARY OF THE INVENTION

The present invention provides a method to reduce vertical banding in an imaging apparatus, such as an ink jet printer, and hence improve the print quality thereof.

The invention, in one form thereof, relates to a method to reduce vertical banding defects in an ink jet printer having a printhead carrier system including a printhead carrier and a carrier motor. The method includes the steps of identifying a disturbance frequency of a disturbance source; identifying a natural frequency of a printhead carrier system; correlating the disturbance frequency of the disturbance source and the natural frequency of the printhead carrier system to a base carrier velocity; selecting a first carrier velocity for printing in a first direction, the first carrier velocity being different from the base carrier velocity; and selecting a second carrier velocity for printing in a second direction, the second carrier velocity being different from the base carrier velocity and different from the first carrier velocity.

In another form thereof, the invention relates to an ink jet printer. The ink jet printer includes a printhead. A printhead carrier system is provided including a printhead carrier for carrying the printhead, the printhead carrier being transported by a carrier motor in a bi-directional scanning path in a reciprocating manner in a first direction and a second direction, the second direction being opposite to the first direction. A controller is communicatively coupled to the printhead and to the printhead carrier system. The controller executes instructions to perform the steps of storing a plurality of carrier velocities in the controller; selecting a first carrier velocity from the plurality of carrier velocities for printing in the first direction; and selecting a second carrier velocity from the plurality of carrier velocities for printing in the second direction, the second carrier velocity being different from the first carrier velocity, wherein the plurality of carrier velocities are selected to reduce vertical banding defects in the ink jet printer.

In still another form, the invention relates to a method of printing in a printer having a printhead carrier, the printhead carrier being driven to scan in a first direction and a second direction opposite to the first direction. The method includes the steps of identifying a base carrier velocity; selecting a first carrier velocity; selecting a second carrier velocity, different from the first carrier velocity, wherein an average of the first carrier velocity and the second carrier velocity is substantially equal to the base carrier velocity; selecting one of the first carrier velocity and the second carrier velocity for scanning the printhead carrier in the first direction; and selecting the other of the first carrier velocity and the second carrier velocity for scanning the printhead carrier in the second scan direction.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
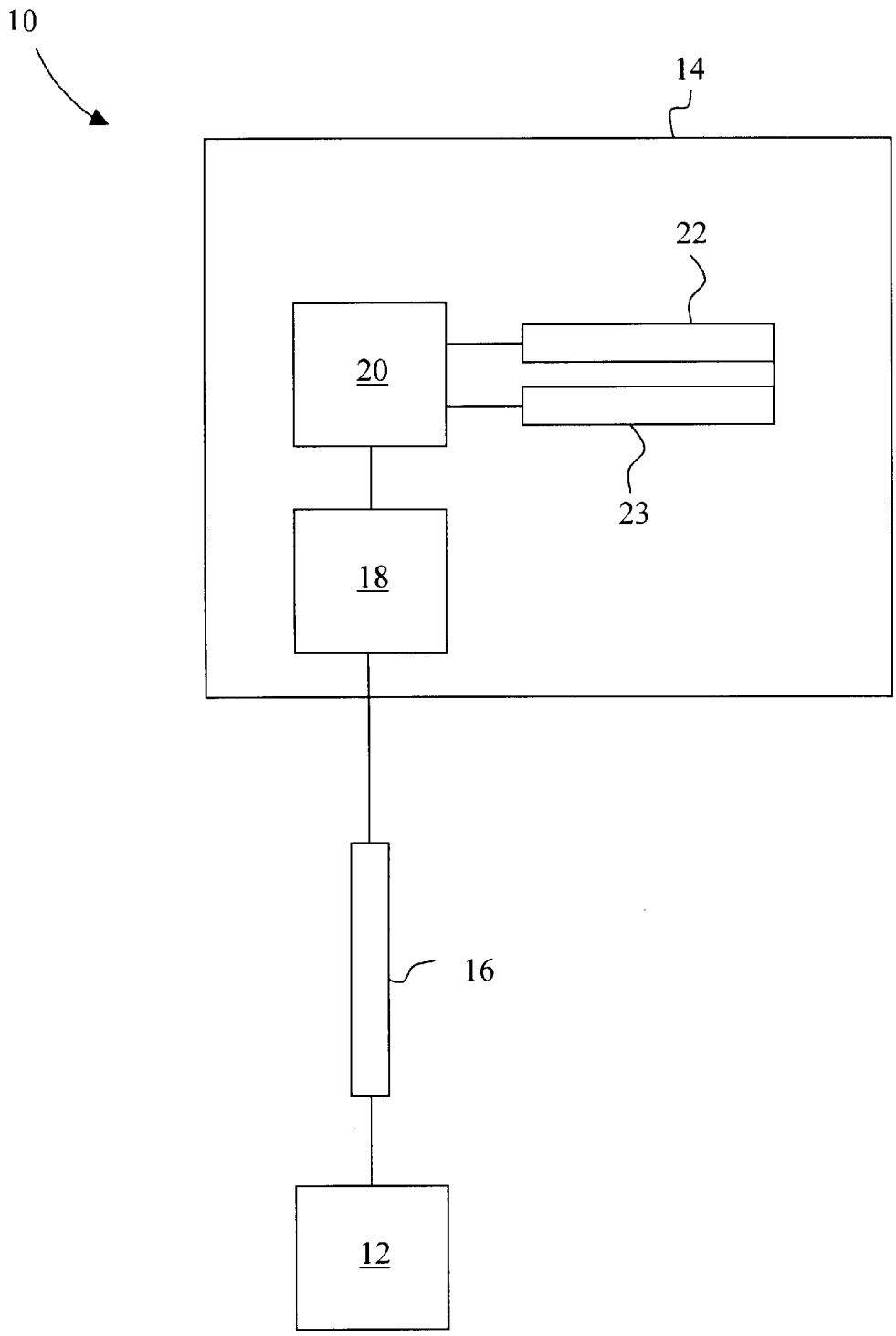
FIG. 1 is a block diagram of an ink jet printer incorporating the present invention.

Referring now to the drawings and particularly to FIG. 1, there is shown a schematic view of an ink jet printing system 10 including a host computer 12 and an ink jet printer 14. Host computer 12 is coupled to ink jet printer 14 via a bi-directional communications link 16. Communications link 16 can be effected, for example, using point-to-point electrical cable connections between serial or parallel ports of ink jet printer 14 and host computer 12, using an infrared transceiver unit at each of ink jet printer 14 and host computer 12, or via a network connection, such as an Ethernet network. Host computer 12 includes application software operated by a user, and provides image data representing an image to be printed, and printing command data, to ink jet printer 14 via communications link 16. During bi-directional communications, ink jet printer 14 supplies printer information, such as for example printer status and diagnostics information, to host computer 12 via communications link 16.

As shown schematically in FIG. 1, ink jet printer 14 includes a data buffer 18, a controller 20, a printhead carrier system 22 and a print media sheet feed unit 23. The printing command data and image data received by ink jet printer 14 from host computer 12 are temporarily stored in data buffer 18. Controller 20, which includes a microprocessor with associated random access memory (RAM) and read only memory (ROM), executes program instructions to retrieve the print command data and printing data from data buffer 18, and processes the printing command data and image data. From the printing command data and the image data, controller 20 executes further instructions to effect the generation of control signals which are supplied to printhead carrier system 22 and print media sheet feed unit 23 to effect the printing of an image on a print medium sheet, such as paper. The image data supplied by host computer 12 to ink jet printer 14 may be in a bit image format, wherein each bit of data corresponds to the placement of an ink dot of a particular color of ink at a particular pixel location in a rectilinear grid of possible pixel locations.

Figure 2:
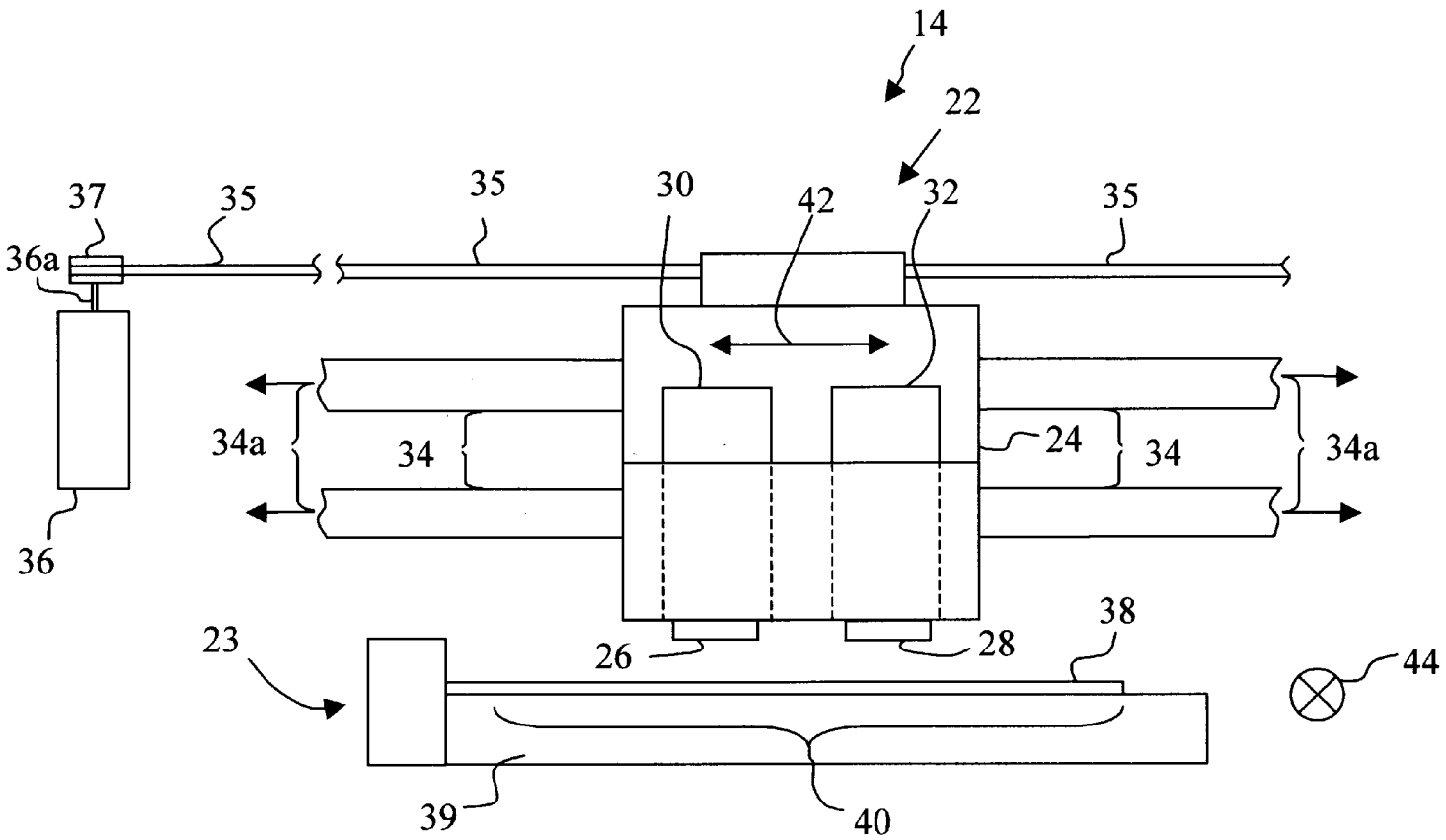
FIG. 2 is a front view of a portion of the ink jet printer of FIG. 1.

Referring to FIG. 2, printhead carrier system 22 includes a printhead carrier 24 for carrying a color printhead 26 and a black printhead 28. A color ink reservoir 30 is provided in fluid communication with color printhead 26, and a black ink reservoir 32 is provided in fluid communication with black printhead 28.

Printhead carrier 24 is guided by a pair of guide rods 34. The axes 34*a* of guide rods 34 define a bi-directional scanning path for printhead carrier 24, and thus, for convenience the bi-directional scanning path will be referred to as bi-directional scanning path 34*a*. Printhead carrier 24 is connected to a carrier transport belt 35 that is driven by a carrier motor 36 via driven pulley 37 to transport printhead carrier 24 in a reciprocating manner along guide rods 34. Carrier motor 36 can be, for example, a DC motor or stepper motor. Carrier motor 36 has a rotating shaft 36*a* which is attached to carrier pulley 37.

The reciprocation of printhead carrier 24 transports ink jet printheads 26, 28 across a print medium sheet 38, such as paper, along bi-directional scanning path 34*a* to define a print zone 40 of ink jet printer 14. This reciprocation occurs in a main scan direction 42 that is parallel with bi-directional scanning path 34*a*, and is also commonly referred to as the horizontal direction. During each scan of printhead carrier 24, print medium sheet 38 is held stationary by print media sheet feed unit 23. Print media sheet feed unit 23 includes an index roller 39 that incrementally advances the print medium sheet 38 in a sheet feed direction 44, also commonly referred to as a sub-scan direction or vertical direction, through print zone 40. As shown in FIG. 2, sheet feed direction 44 is depicted as an X within a circle to indicate that the sheet feed direction is in a direction perpendicular to the plane of FIG. 2, toward the reader.

Sheet feed direction 44 is substantially perpendicular to main scan direction 42, and in turn, substantially perpendicular to bi-directional scanning path 34*a*. Printhead carrier system 22 and printheads 26, 28 may be configured for unidirectional printing or bi-directional printing.

Depending upon the particular design of ink jet printer 14, color ink reservoir 30 may be fixedly attached to color printhead 26 so as to form a unitary color printhead cartridge. Alternatively, color ink reservoir 30 may be removably attached to color printhead 26 so as to permit the replacement of color ink reservoir 30 separate from the replacement of color printhead 26, and in this alternative color ink reservoir 30 is located on-carrier in close proximity to color printhead 26. In another alternative, color ink reservoir 30 may be located off-carrier at a location remote from color printhead 26.

Likewise, black ink reservoir 32 may be fixedly attached to black printhead 28 so as to form a unitary black printhead cartridge. Alternatively, black ink reservoir 32 may be removably attached to black printhead 28 so as to permit the replacement of black ink reservoir 32 separate from the replacement of black printhead 28, and in this alternative black ink reservoir 32 is located on-carrier in close proximity to black printhead 28. In another alternative, black ink reservoir 32 may be located off-carrier at a location remote from black printhead 28.

Figure 3:
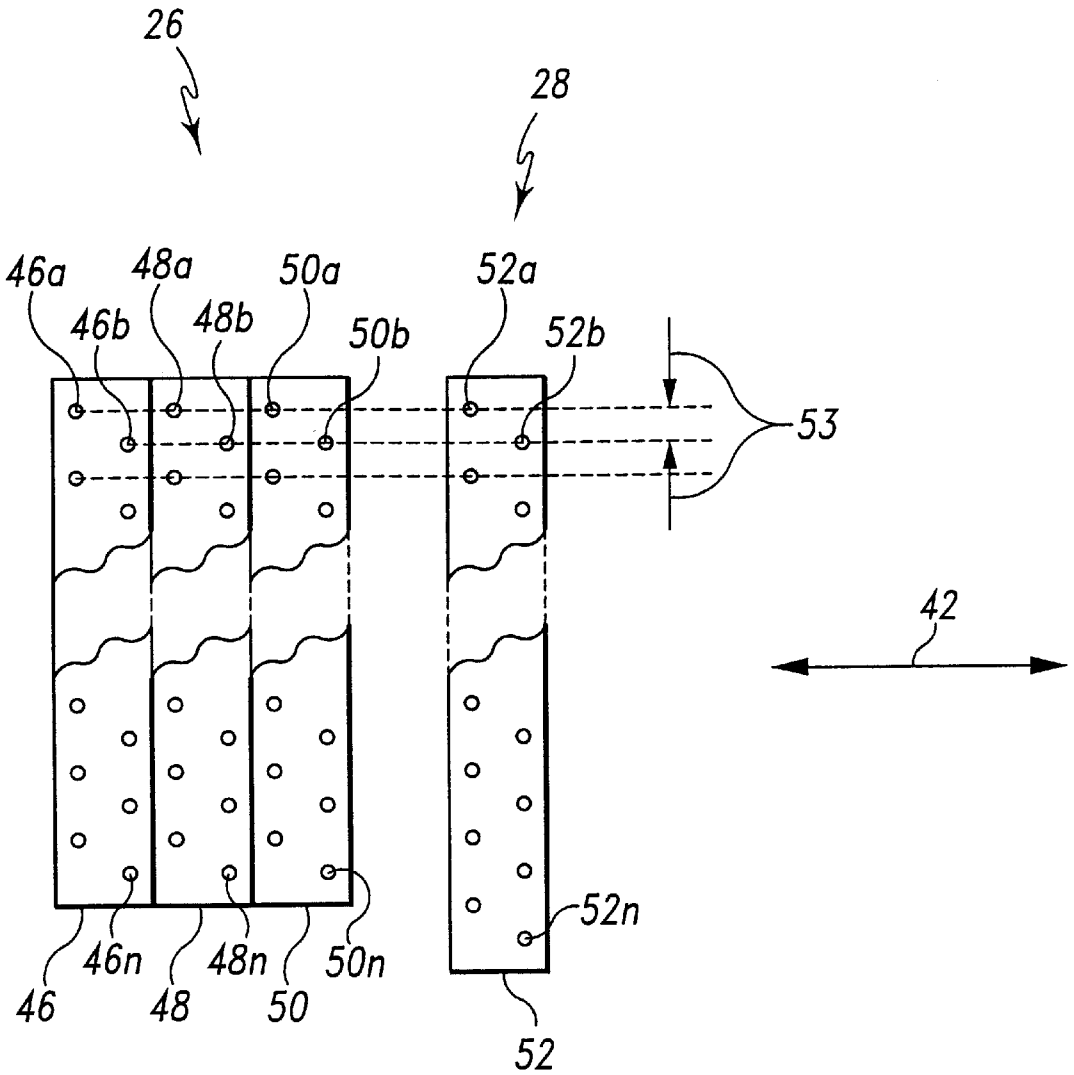
FIG. 3 is a plane view of a plurality of printhead nozzle arrays.

Referring to FIG. 3, color printhead 26 includes three printhead nozzle arrays 46, 48, and 50, and black printhead 28 includes a printhead nozzle array 52. As shown in FIG. 3, each of nozzle arrays 46, 48, 50, 52 includes a plurality of ink jetting nozzles, 46*a*–46*n*, 48*a*–48*n*, 50*a*–50*n* and 52*a*–52*n*, respectively. Such nozzles are sometimes also referred to as orifices. In the embodiment shown, the three printhead nozzle arrays 46, 48, and 50 will sometimes be referred to as cyan nozzle array 46, magenta nozzle array 48 and yellow nozzle array 50, although it is to be understood that other colors could be associated with printhead nozzle arrays 46, 48, and 50. Also, it is contemplated that printhead nozzle arrays 46, 48, and 50 can be formed as three nozzle arrays in a single printhead, or as individual printhead nozzle arrays in three different printheads. Each nozzle of the plurality of ink jetting nozzles 46*a*–46*n*, 48*a*–48*n*, 50*a*–50*n* and 52*a*–52*n* individually has an associated actuator, such as a heater element or a piezoelectric element, which, when energized at the directive of controller 20, causes an ink drop to be expelled from the nozzle. Thus, each ink jetting nozzle 46*a*–46*n*, 48*a*–48*n*, 50*a*–50*n* and 52*a*–52*n* of each of printhead nozzle arrays 46, 48, 50, 52 can be individually and selectively actuated by controller 20 to expel an ink drop to form a corresponding ink dot on print medium sheet 38.

As shown in FIG. 3, the plurality of ink jetting nozzles in each of nozzle arrays 46, 48, 50, 52 are disposed in a staggered and horizontally adjacent relationship relative to each other. In the embodiment shown, a vertical nozzle spacing 53 between two consecutive staggered nozzles is one six-hundredth of an inch, thereby permitting 600 dpi printing with no level of interlaced printing. The top-most ink jetting nozzles 46*a*, 48*a*, 50*a* of color printhead 26 are positioned in horizontal alignment so that, when color printhead 26 is installed in printhead carrier 24, ink jetting nozzles 46*a*, 48*a*, 50*a* will travel along the bi-directional scanning path 34*a* parallel to main scan direction 42 and trace along the same raster and print along the same printing line. The same relationship holds true for orifices 46*b*–*n*, 48*b*–*n* and 50*b*–*n*, respectively.

When printheads 26, 28 are installed in printhead carrier 24, printhead nozzle arrays 46, 48 and 50 will be positioned in carrier 24 in relation to the position of printhead nozzle array 52, such that certain color nozzles of the color printhead 26 will trace the same raster as would the horizontally aligned black nozzle of black printhead 28. However, since printhead nozzle array 52 is vertically taller than printhead nozzle arrays 46, 48 and 50, there is not a mutual one-to-one correspondence between the color and black nozzles for the full height of printhead nozzle array 52. It will be appreciated that the number of ink emitting orifices within each printhead nozzle array 46, 48, 50, 52 may vary from that shown, and the physical position of the cyan, yellow and magenta nozzle arrays 46, 48 and 50 relative to each other may vary without departing from the scope of the invention, so long as at least some of the nozzles in two or more of the color nozzle arrays 46, 48 and 50 are in horizontal alignment.

Ideally, printhead carrier system 22 should move printheads 26, 28 located in printhead carrier 24 so that the ink dots are placed to produce an image without visible defects. However, it has been observed that vibrations are generated in the printhead carrier system 22 of ink jet printer 14 as printhead carrier 24 is transported back and forth in main scan direction 42 during printing.

Based upon observations leading up to the present invention, it has been determined that vertical banding, in large part, is a result of such vibrations of printhead carrier system 22, which will be referred to herein as carrier vibrations. Carrier vibrations can be, for example, fixed position carrier vibrations and fixed frequency carrier vibrations. The carrier vibrations result in ink dot placement errors, i.e., defects. Ink dot placement can be measured in the x-direction, i.e., main scan direction 42, and in the y-direction, i.e., in sheet feed direction 44. A vision system can be used to measure the dot placement accuracy in both the x-direction and the y-direction.

Figure 4:
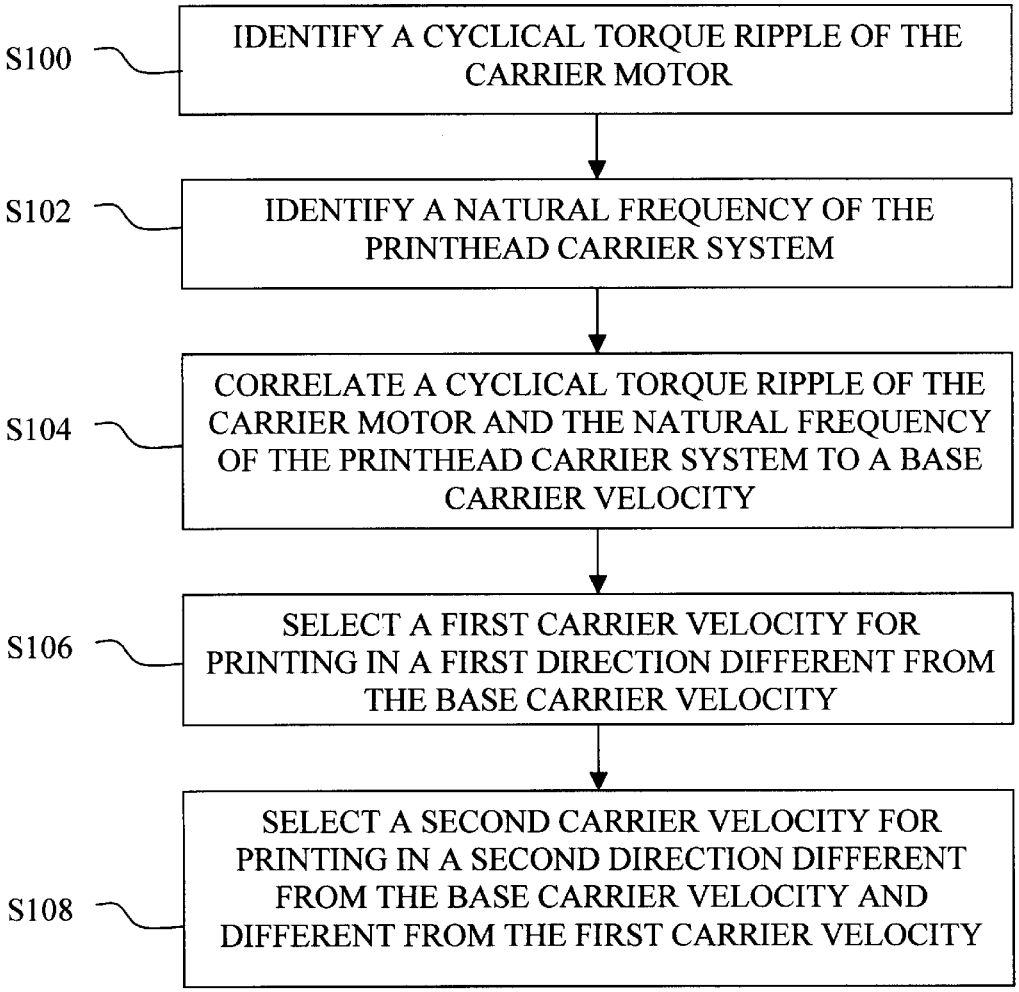
FIG. 4 is a flow chart of one method of the invention to reduce vertical banding defects in the ink jet printer of FIG. 1.

FIG. 4 is a flow chart of one method of the invention to reduce vertical banding defects in ink jet printer 14. The method is effective in reducing vertical banding defects resulting from one or both of fixed position carrier vibration and fixed frequency carrier vibration without adding any hardware cost to the printer design and with no loss of printer functionality and performance.

At step S100, a cyclical torque ripple of carrier motor 36 is identified. The cyclical torque ripple is one example of a disturbance frequency, and carrier motor 36 is one example of a disturbance source. During operation of ink jet printer 14, carrier motor 36 exhibits cyclical torque ripple during each revolution of drive shaft 36*a*. It has been observed that the carrier motor torque ripple of carrier motor 36 is a major contributor to fixed position carrier vibrations as printhead carrier 24 is propelled along bi-directional scanning path 34*a*. Fixed position carrier vibrations result in a vibration pattern that repeatedly occurs at the same horizontal carrier position(s) along bi-directional scanning path 34*a* regardless of the scanning velocity of printhead carrier 24.

The x-dot placement error associated with fixed position carrier vibrations can be observed, for example, by printing a repeating pattern of dots, such as a one on-two off pattern of dots, in the horizontal direction, and then measure the x-dot placement accuracy to thereby determine the frequency content of the printed pattern associated with the cyclical torque ripple of carrier motor 36. The horizontal direction corresponds to main scan direction 42. From the frequency content of the printed pattern, it can be determined the cyclical torque ripple of carrier motor 36 in cycles of dot placement errors, such as for example, a cyclical torque ripple of 5 cycles per revolution and 10 cycles per revolution yields cyclic dot placement errors at corresponding frequencies of 4.6 and 9.2 cycles per inch, respectively.

In addition, printhead carrier system 22 is an electro-mechanical system, and as such, will possess at least one natural frequency, also referred to as a resonant frequency, which when excited will cause vibrations to be experienced by printhead carrier 24. It has been observed that the natural frequency of vibration of printhead carrier system 22 as printhead carrier 24 is propelled along bi-directional scanning path 34*a* is a major contributor to fixed frequency carrier vibrations. The fixed frequency carrier vibrations can be observed as fixed frequency cyclic y-direction dot placement errors. In ink jet printer 14, the y-direction corresponds to sheet feed direction 44. One source of the excitation of the natural frequency of printhead carrier system 22 is the cyclical torque ripple of carrier motor 36.

At step S102, a natural frequency of printhead carrier system 22 is identified. The natural frequency of printhead carrier system 22 can be determined by observing the cyclic y-direction dot placement errors at various carrier velocities. The resonant frequency of printhead carrier systems will vary among different types of ink jet printers. However, for ink jet printer 14, such a resonant frequency may be, for example, found to be 92 cycles per second, i.e., 92 hertz.

At step S104, the cyclical torque ripple of carrier motor 36 and the natural frequency of printhead carrier system 22 are correlated to a base carrier velocity VB. For example, if the natural frequency of printhead carrier system 22 is 92 hertz, and if the cyclical torque ripple of carrier motor 36 of 5 cycles per revolution and 10 cycles per revolution is found to excite the natural frequency of printhead carrier system 22, then the cyclical torque ripple and the natural frequency of printhead carrier system 22 can be correlated to a particular base carrier velocity VB of printhead carrier 24.

Figures 5, 6, 7:
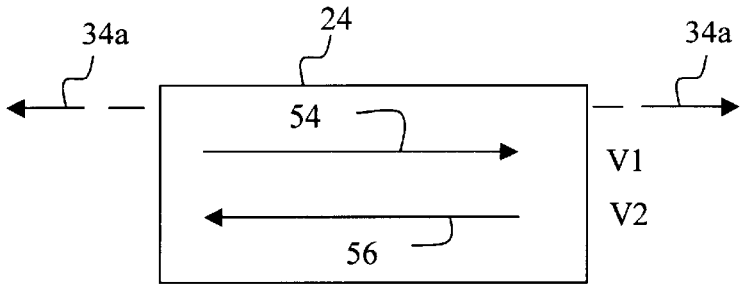
FIG. 5 is a diagrammatic illustration of printing using the invention.
FIG. 6 is a table that presents a carrier velocity pattern that may be utilized in practicing the invention.
FIG. 7 is another table that presents a carrier velocity pattern that may be utilized in practicing the invention.

Referring to FIGS. 4 and 5, at step S106, a first carrier velocity V1 is selected for printing in a first direction 54, that is different from the base carrier velocity VB. And, at step S108, a second carrier velocity V2 is selected for printing in a second direction 56, that is different from the base carrier velocity VB and different from the first carrier velocity V1. As illustrated diagrammatically in FIG. 5, in the simplest form thereof, the present invention utilizes at least two different printing speeds, wherein the first carrier velocity V1 is selected for scanning printhead carrier 24 in the first direction 54, for example from left to right, along bi-directional scanning path 34*a* for printing a first printing swath, and wherein the second carrier velocity V2 is selected for scanning printhead carrier 24 in a second direction 56, for example from right to left, along bi-directional scanning path 34*a* for printing a second printing swath. Using different carrier velocities for printhead carrier 24 for print passes in opposite printing directions 54, 56 smoothes out vertical banding due to fixed position carrier vibration, and masks vertical banding due to fixed frequency carrier vibration.

As illustrated by the table of FIG. 6, consecutive passes of printhead carrier can follow an alternating carrier velocity pattern, i.e., V1, V2, V1, V2, etc. Such a pattern is useful for bi-directional printing. Alternatively, as illustrated in FIG. 7, the carrier velocity pattern can be a rotating pattern, i.e., V1, V2, V2, V1, V1, V2, V2, V1, etc. The pattern of FIG. 7 may be used in both unidirectional printing and bi-directional printing. Still further, it is contemplated that other velocity patterns may be possible, such as for example, a random pattern of velocities V1 and V2.

Preferably, carrier velocities V1, V2 are selected to avoid the base carrier velocity VB associated with the excited natural frequency of printhead carrier system 22. In the example above, it is assumed that the natural frequency of printhead carrier system 22 is 92 hertz, and the cyclical torque ripple of carrier motor 36 is 5 cycles per revolution and 10 cycles per revolution. It will be further assumed in this example that base carrier velocity VB at which the natural frequency of printhead carrier system 22 is excited by the cyclical torque ripple of carrier motor 36 of 5 cycles per revolution and 10 cycles per revolution, is 20 inches per second (ips). Accordingly, the carrier velocities V1 and V2 are selected to be some velocity other than the base carrier velocity VB, i.e., some velocity other than 20 ips, so that the natural frequency of printhead carrier system 22 is not excited. For example, carrier velocities of 15 ips for carrier V1, and 25 ips for carrier velocity V2 have been found to avoid excitation of the natural frequency of 92 hertz of printhead carrier system 22, while maintaining an average carrier velocity of 20 ips. However, it is to be understood that other combinations of velocities that do not average to the carrier velocity associated with the natural frequency of the carrier system may be used, such as for example: V1=15 and V2=26. While the range of permissible velocity variations is dependent upon the electro-mechanical characteristics of the printer, it has been determined that for ink jet printer 14, an exemplary carrier velocity range may be 15 ips$\leqq$(V1, V2)$\leqq$30 ips, and preferably, the velocity for carrier velocity V1 and the velocity for carrier velocity V2 is selected to not be equal to the base carrier velocity VB.

Figures 8A, 8B:
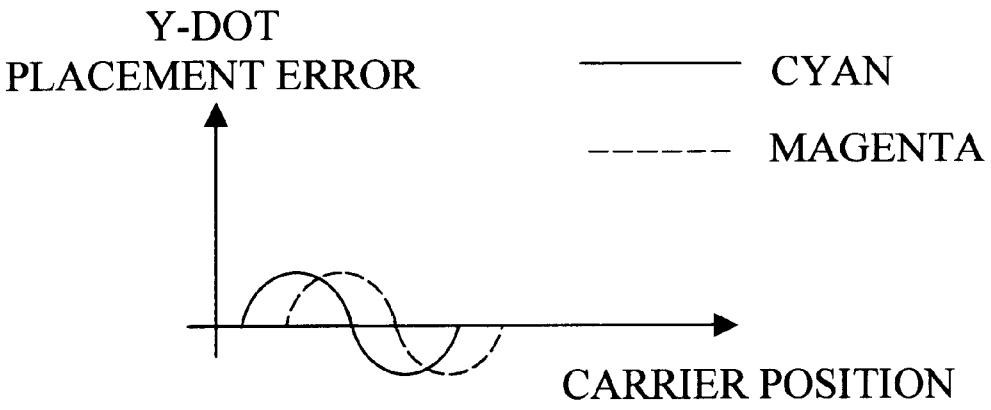
FIG. 8A illustrates, with respect to the printhead nozzle array configuration depicted in FIG. 3, the relationship between y-dot placement errors in relation to carrier positions.
FIG. 8B shows in tabular form the phase separation between cyan nozzles and magenta nozzles of the printhead nozzle array.

FIG. 8A illustrates, with respect to the printhead nozzle array configuration depicted in FIG. 3, the relationship between y-dot placement errors in relation to carrier positions along bi-directional path 34*a* for cyan nozzle array 46 and magenta nozzle array 48 of color printhead 26. In this example, it is assumed that the horizontal spacing between cyan nozzles 46*a*–46*n* and magenta nozzles 48*a*–48*n*, respectively, is 42/600 of an inch, and is based on a natural frequency of printhead carrier system 22 of 92 hertz. FIG. 8B shows in tabular form that the phase separation between cyan nozzles 46*a*–46*n* and magenta nozzles 48*a*–48*n*, respectively, can be changed based on the selected carrier velocity. For example, a carrier velocity of 6.4 ips corresponds to a phase separation of 0.0 degrees; a carrier velocity of 12.9 ips corresponds to a phase separation of 180.0 degrees; a carrier velocity of 19.3 ips corresponds to a phase separation of 90.0 degrees; and a carrier velocity of 25.8 ips corresponds to a phase separation of 45.0 degrees. Thus, by changing the carrier velocities from one pass to another, the y-dot placement errors can be effectively masked by utilizing the corresponding changes in phase separation.

The carrier velocities V1 and V2 may be determined empirically. For example, by separating the carrier velocities V1 and V2 for print speeds in the different directions 54, 56 of printing, carrier velocities V1 and V2 can be chosen for each print direction 54, 56 that have the lowest measured horizontal x-dot placement errors due to fixed position carrier vibration and the lowest measured vertical y-dot placement errors due to fixed frequency vibration of the carrier. As an additional criteria for selecting carrier velocities V1 and V2, the different values for carrier velocities V1 and V2 can be selected based on a variety of printing conditions, such as for example, depending upon the shingling mode, printing swath width, printer throughput rate, and print quality mode. These various values for carrier velocities V1 and V2, as correlated to printing conditions, can then be stored in a look-up table for use by controller 20 during printing.

It is contemplated that under some circumstances it may be desirable to include more than two carrier velocities, for example carrier velocities V1, V2 . . . Vn, for combinations of printing passes associated with scanning directions 54, 56 of printhead carrier 24, for either unidirectional printing or bi-directional printing, to further reduce vertical banding defects.

Once a range of potential carrier velocities V1, V2, . . . Vn has been determined, one approach that can be used in selecting a particular carrier velocity for a particular printing pass in one of directions 54, 56 is by a random selection of a random velocity Vr using a random generator. The random generator can be incorporated into controller 20. It has been observed that randomly varying the carrier velocity of a printhead carrier, such as printhead carrier 24, aids in dissipating any printing defect patterns resulting from using the same carrier velocities in a predetermined pattern of printing passes. The random generator selects the random velocity Vr based on the algorithm: $V_{min} \leqq V_r \leqq V_{max}$, wherein Vmin and Vmax represent the range of possible carrier velocities V1, V2, . . . Vn, and wherein Vmin and Vmax represent the minimum and maximum carrier velocities, respectively, within carrier velocity range V1, V2, . . . Vn.

Figure 9:
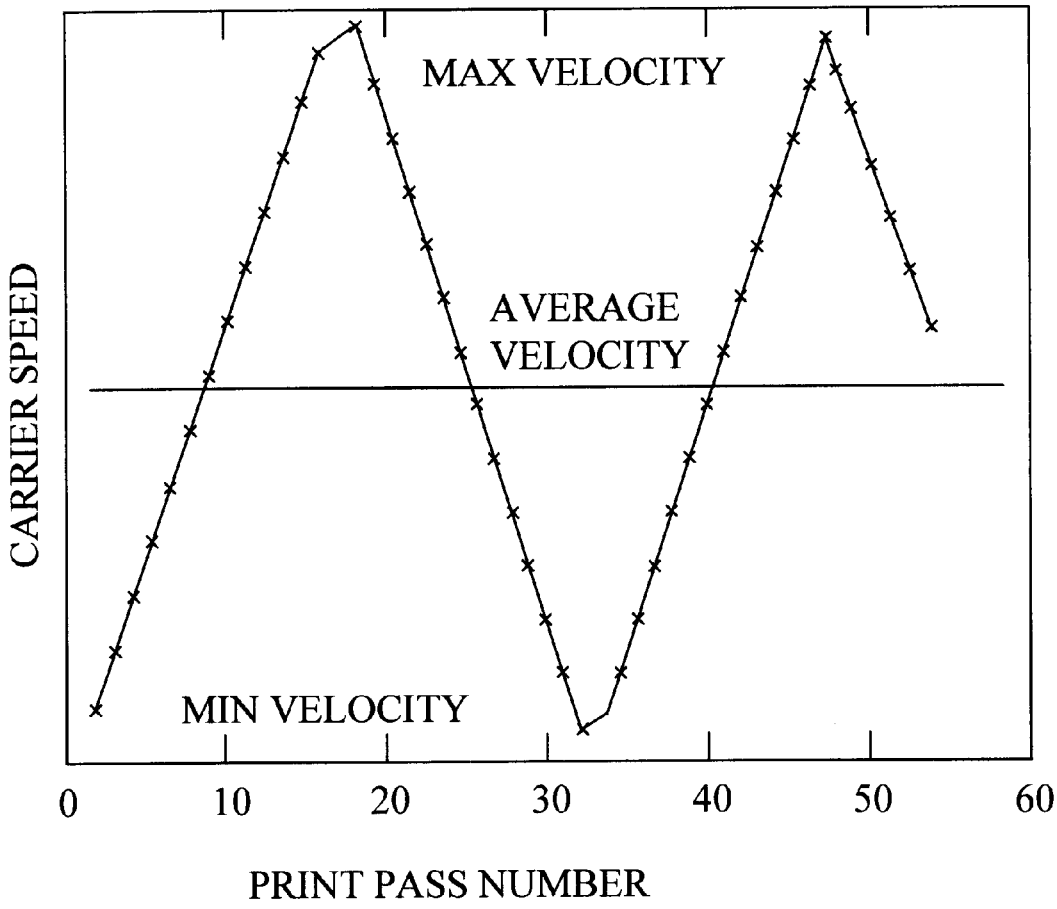
FIG. 9 depicts one example of a periodic selection algorithm for selecting a carrier velocity from a plurality of potential carrier velocities.

Another approach for selecting a carrier velocity from a range of carrier velocities V1, V2, . . . Vn is to adopt a periodic selection algorithm, such as one corresponding to the saw-tooth waveform of FIG. 9. As shown in FIG. 9, the carrier velocity for a particular printing pass of consecutive printing passes is selected to gradually increase and the gradually decrease.

Still another approach for selecting a carrier velocity from a range of carrier velocities V1, V2, . . . Vn is to store the carrier velocities in a pseudorandom sequence in a look-up table, and then sequentially select a carrier velocity for a particular printing swath of consecutive printing swaths.

Still another approach is to select from the range of carrier velocities V1, V2, . . . Vn based on the additional criteria of one or more of a variety of printing conditions, such as for example, depending upon the shingling mode, printing swath width, printer throughput rate, and print quality mode. These various values for carrier velocities, as correlated to printing conditions, can then be stored in a look-up table for use by controller 20 during printing of consecutive printing passes in directions 54, 56.

Figure 10:
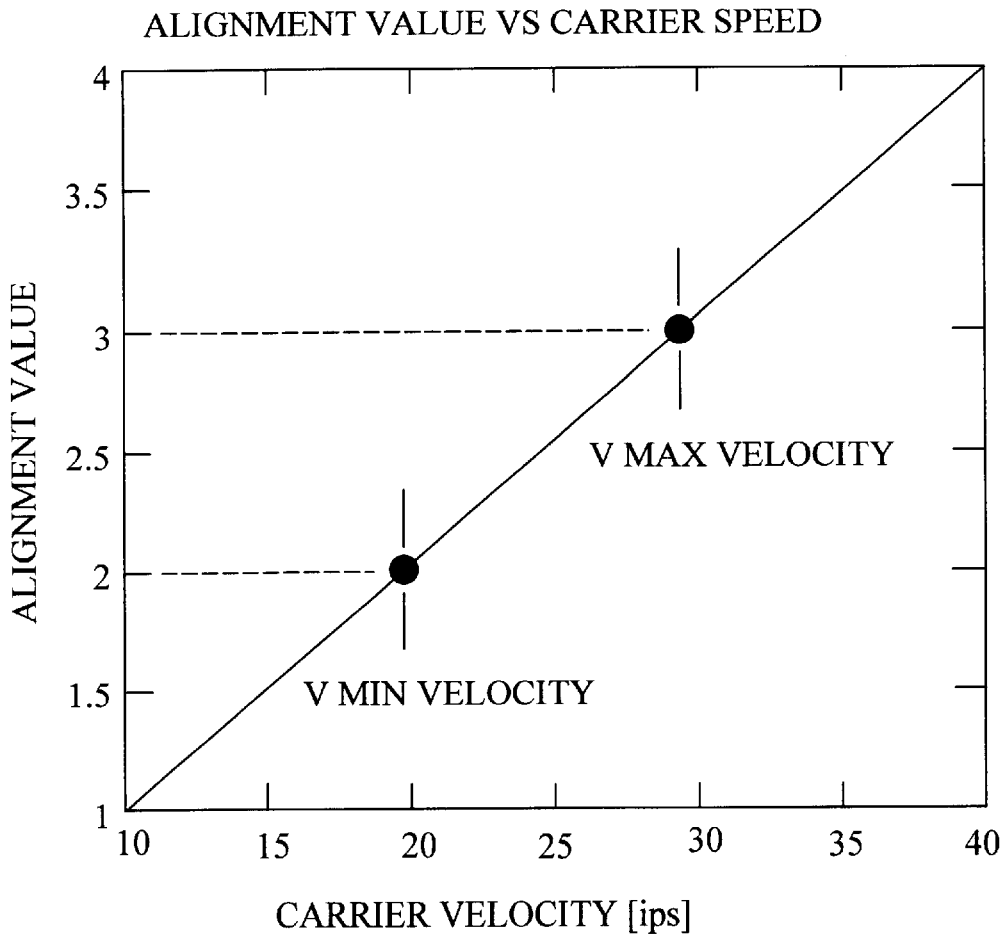
FIG. 10 is an interpolation graph, showing how carrier alignment values relate to carrier velocities.

FIG. 10 is an interpolation graph, showing how carrier alignment values relate to carrier velocities. Printhead carrier alignment is a factor that affects printing quality. Printhead carrier alignment refers to the ability of the printhead, such as printhead 26, to place a first ink dot at a particular pixel location on a first pass of printhead carrier 24 in direction 54, and then place a second ink dot exactly on top of the first ink in a return pass of printhead carrier 24 in direction 56. In order to effect printhead carrier alignment, carrier alignment values may be utilized to create printing offsets in main scan direction 42, in either or both of directions 54, 56, to correct for any printhead carrier misalignment during bi-directional printing. With regard to the present invention, it has been discovered that by selecting carrier velocities, for example carrier velocities V1 and V2, whose average is equal to the carrier alignment velocity used for carrier alignment, then the carrier alignment offset values used to correct for printhead carrier misalignment need not be modified.

However, if carrier velocities V1 and V2 do not average to be equal to the carrier alignment velocity, then it may be advantageous to predict new carrier alignment values to compensate for the deviation of the carrier velocity average from the carrier alignment velocity. FIG. 10 shows that, for a range of carrier velocities from Vmin to Vmax, and by correlating a printhead carrier alignment value to each of carrier velocities Vmin and Vmax, then through linear interpolation, carrier alignment values can be selected to compensate for changes in carrier velocity.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method to reduce vertical banding defects in an ink jet printer having a printhead carrier system including a printhead carrier and a carrier motor, comprising the steps of:

identifying a disturbance frequency of a disturbance source;

identifying a natural frequency of said printhead carrier system;

correlating said disturbance frequency of said disturbance source and said natural frequency of said printhead carrier system to a base carrier velocity;

selecting a first carrier velocity for printing in a first direction, said first carrier velocity being different from said base carrier velocity; and selecting a second carrier velocity for printing in a second direction, said second carrier velocity being different from said base carrier velocity and different from said first carrier velocity.

2. The method of claim 1, wherein said first carrier velocity is selected to be one of either greater than said base carrier velocity and less than said base carrier velocity, and said second carrier velocity is selected to be the other of said greater than said base carrier velocity and less than said base carrier velocity.

3. The method of claim 1, wherein said first direction and said second direction are opposite directions.

4. The method of claim 1, wherein a printed image is generated by printing during a plurality of printing passes of said printhead carrier, said plurality of printing passes including odd numbered printing passes and even numbered printing passes, and wherein said printhead carrier is transported at said first carrier velocity during said odd numbered printing passes, and said printhead carrier is transported at said second carrier velocity during said even numbered printing passes.

5. The method of claim 1, wherein a printed image is generated by printing during a plurality of printing passes of said printhead carrier, and wherein said printhead carrier is transported at said first carrier velocity during a first plurality of consecutive printing passes, and said printhead carrier is transported at said second carrier velocity during a second plurality of consecutive printing passes.

6. The method of claim 1, wherein a printed image is generated by printing during a plurality of printing passes of said printhead carrier, and wherein said printhead carrier is transported at said first carrier velocity during first printing passes, and said printhead carrier is transported at said second carrier velocity during second printing passes, and wherein said first printing passes and said second printing passes are randomly selected from a range of values.

7. The method of claim 1, wherein said disturbance source is said carrier motor and said disturbance frequency is a frequency of a cyclical torque ripple of said carrier motor.

8. The method of claim 7, wherein the step of identifying said frequency of said cyclical torque ripple of said carrier motor includes the steps of:

printing a plurality of spaced dots in a main scan direction; and measuring a dot placement error of said plurality of spaced dots.

9. The method of claim 8, wherein the step of measuring is performed in a main scan direction.

10. The meted of claim 1, wherein the step of identifying said natural frequency of said printhead carrier system includes the steps of:

printing a plurality of spaced dots in a main scan direction; and measuring a dot placement error of said plurality of spaced dots.

11. The method of claim 10, wherein the step of measuring is performed in a direction perpendicular to said main scan direction.

12. The meted of claim 1, wherein an average of said first carrier velocity and said second carrier velocity is equal to a carrier alignment velocity.

13. The method of claim 1, further comprising the steps of utilizing a printhead carrier alignment value associated with a carrier alignment velocity during bi-directional printing, wherein if an average of said first carrier velocity and said second carrier velocity is not equal to said carrier alignment velocity, then changing said carrier alignment value.

14. The method of claim 1, wherein said first carrier velocity and said second carrier velocity are selected to minimize cyclic dot placement errors.

15. An ink jet printer, comprising:

a printhead;

a printhead carrier system including a printhead carrier for carrying said printhead, said printhead carrier being transported by a carrier motor in a bi-directional scanning path in a reciprocating manner in a first direction and a second direction, said second direction being opposite to said first direction; and a controller communicatively coupled to said printhead and said printhead carrier system, said controller executing instructions to perform the steps of:

storing a plurality of carrier velocities in said controller;

selecting a first carrier velocity from said plurality of carrier velocities for printing in said first direction; and selecting a second carrier velocity from said plurality of carrier velocities for printing in said second direction, said second carrier velocity being different from said first carrier velocity, wherein said plurality of carrier velocities are selected to reduce vertical banding defects in said ink jet printer, and wherein said carrier motor has a cyclical torque ripple and said printhead carrier system has a natural frequency, and wherein said cyclical torque ripple of said carrier motor excites said natural frequency of said printhead carrier system at a base carrier velocity, and wherein each of said first carrier velocity and said second carrier velocity is different from said base carrier velocity.

16. An ink jet printer, comprising:

a printhead;

a printhead carrier system including a printhead carrier for carrying said printhead, said printhead carrier being transported by a carrier motor in a bi-directional scanning path in a reciprocating manner in a first direction and a second direction, said second direction being opposite to said first direction; and a controller communicatively coupled to said printhead and said printhead carrier system, said controller executing instructions to perform the steps of:

storing a plurality of carrier velocities in said controller;

selecting a first carrier velocity from said plurality of carrier velocities for printing in said first direction; and selecting a second carrier velocity from said plurality of carrier velocities for printing in said second direction, said second carrier velocity being different from said first carrier velocity, wherein said plurality of carrier velocities are selected to reduce vertical banding defects in said ink jet printer, and wherein said carrier motor has a cyclical torque ripple and said printhead carrier system has a natural frequency, and wherein said cyclical torque ripple of said carrier motor excites said natural frequency of said printhead carrier system at a base carrier velocity, and wherein each of said plurality of carrier velocities is different from said base carrier velocity.

17. An ink jet printer, comprising:

a printhead;

a printhead carrier system including a printhead carrier for carrying said printhead, said printhead carrier being transported by a carrier motor in a bi-directional scanning path in a reciprocating manner in a first direction and a second direction, said second direction being opposite to said first direction; and a controller communicatively coupled to said printhead and said printhead carrier system, said controller executing instructions to perform the steps of:

storing a plurality of carrier velocities in said controller;

selecting a first carrier velocity from said plurality of carrier velocities for printing in said first direction; and selecting a second carrier velocity from said plurality of carrier velocities for printing in said second direction, said second carrier velocity being different from said first carrier velocity, wherein said plurality of carrier velocities are selected to reduce vertical banding defects in said ink jet printer, and wherein said first carrier velocity and said second carrier velocity are further selected randomly from a range of said plurality of carrier velocities.

18. An ink jet printer, comprising:

a printhead;

a printhead carrier system including a printhead carrier for carrying said printhead, said printhead carrier being transported by a carrier motor in a bi-directional scanning path in a reciprocating manner in a first direction and a second direction, said second direction being opposite to said first direction; and a controller communicatively coupled to said printhead and said printhead carrier system, said controller executing instructions to perform the steps of:

storing a plurality of carrier velocities in said controller;

selecting a first carrier velocity from said plurality of carrier velocities for printing in said first direction; and selecting a second carrier velocity from said plurality of carrier velocities for printing in said second direction, said second carrier velocity being different from said first carrier velocity, wherein said plurality of carrier velocities are selected to reduce vertical banding defects in said ink jet printer, and wherein values for each of said first carrier velocity and said second carrier velocity are selected to increase and then decrease in a periodic manner for successive printing passes of said printhead carrier.

19. An ink jet printer comprising:

a printhead;

a printhead carrier system including a printhead carrier for carrying said printhead, said printhead carrier being transported by a carrier motor in a bi-directional scanning path in a reciprocating manner in a first direction and a second direction, said second direction being opposite to said first direction; and a controller communicatively coupled to said printhead and said printhead carrier system, said controller executing instructions to perform the steps of:

storing a plurality of carrier velocities in said controller;

selecting a first carrier velocity from said plurality of carrier velocities for printing in said first direction; and selecting a second carrier velocity from said plurality of carrier velocities for printing in said second direction, said second carrier velocity being different from said first carrier velocity, wherein said plurality of carrier velocities are selected to reduce vertical banding defects in said ink jet printer, and wherein an average of said first carrier velocity and said second carrier velocity is equal to a carrier alignment velocity.

20. An ink jet printer, comprising:

a printhead;

a printhead carrier system including a printhead carrier for carrying said printhead, said printhead carrier being transported by a carrier motor in a bi-directional scanning path in a reciprocating manner in a first direction and a second direction, said second direction being opposite to said first direction; and a controller communicatively coupled to said printhead and said printhead carrier system, said controller executing instructions to perform the steps of:

storing a plurality of carrier velocities in said controller;

selecting a first carrier velocity from said plurality of carrier velocities for printing in said first direction; and selecting a second carrier velocity from said plurality of carrier velocities for printing in said second direction, said second carrier velocity being different from said first carrier velocity, wherein said plurality of carrier velocities are selected to reduce vertical banding defects in said ink jet printer, and wherein a printhead carrier alignment value is associated with a carrier alignment velocity for use during bi-directional printing, and wherein if an avenge of said first carrier velocity and said second carrier velocity is not equal to said carrier alignment velocity, then said carrier alignment value is changed.

21. A method of printing in a printer having a printhead carrier, said printhead carrier being driven to scan in a first direction and a second direction opposite to said first direction, comprising the steps of:

identifying a base carrier velocity;

selecting a first carrier velocity;

selecting a second carrier velocity, different from said first carrier velocity, wherein an average of said first carrier velocity and said carrier velocity is substantially equal to said base carrier velocity;

selecting one of said first carrier velocity and said second carrier velocity for scanning said printhead carrier in said first direction; and selecting the other of said first carrier velocity and said second carrier velocity for scanning said printhead carrier in said second scan direction.

22. The method of claim 21, wherein said base carrier velocity is a carrier velocity at which a natural frequency associated with said printhead carrier is excited.

* * * * *